US008961047B2

(12) United States Patent
Gueret et al.

(10) Patent No.: US 8,961,047 B2
(45) Date of Patent: Feb. 24, 2015

(54) APPLICATOR DEVICE FOR A COSMETIC PRODUCT, AND ASSEMBLY COMPRISING SAME

(75) Inventors: Charlotte Gueret, Bordeaux (FR); François Dorlodot Des Essarts, Hove west Sussex (GB)

(73) Assignee: L'Oreal, Paris (FR)

( * ) Notice: Subject to any disclaimer, the term of this patent is extended or adjusted under 35 U.S.C. 154(b) by 916 days.

(21) Appl. No.: 13/004,598

(22) Filed: Jan. 11, 2011

(65) Prior Publication Data

US 2011/0222952 A1 Sep. 15, 2011

Related U.S. Application Data

(60) Provisional application No. 61/320,546, filed on Apr. 2, 2010.

(30) Foreign Application Priority Data

Jan. 12, 2010 (FR) ..... 10 50175

(51) Int. Cl.
*A46B 5/02* (2006.01)
*A45D 34/04* (2006.01)
(Continued)

(52) U.S. Cl.
CPC ..... *A45D 34/042* (2013.01); *A45D 40/20* (2013.01); *A46B 11/0024* (2013.01); *A46B 11/0027* (2013.01); *B43K 23/008* (2013.01); *A45D 2034/002* (2013.01); *A45D 2040/201* (2013.01);
(Continued)

(58) Field of Classification Search
CPC .... B43K 23/00; B43K 23/001; B43K 23/004; B43K 23/008; B43K 23/012; B43K 23/016; B43K 23/02; B43K 23/04; B25G 1/102; B25G 1/105; B25G 1/12; B25G 1/01; B25G 1/02; B25G 1/10
USPC ..... 401/6–8, 88; 16/430
See application file for complete search history.

(56) References Cited

U.S. PATENT DOCUMENTS 657,370 A 9/1900 Ward
3,505,700 A 4/1970 Rodriguez
(Continued)

FOREIGN PATENT DOCUMENTS

EP 0 577 837 A1 1/1994
EP 1 920 676 5/2008
(Continued)

OTHER PUBLICATIONS

Preliminary International Search Report issued Sep. 2, 2010 in French Application No. 1050175.

*Primary Examiner* — David Walczak
(74) *Attorney, Agent, or Firm* — Novak Druce Connolly Bove + Quigg LLP

(57) ABSTRACT

An applicator for a cosmetic product that includes a body, a cosmetic applicator member connected to a first longitudinal end of the body, a holding ring adapted to be engaged around an anterior phalange of one of the user's fingers, with a size adapted to allow simultaneous bearing of two opposite zones of the ring on the finger when the anterior phalange is engaged through the ring, the ring being connected to a second longitudinal end of the body opposite the first, such that the body offers at least one bearing zone for an end phalange of said finger of the user when the anterior phalange is engaged through the ring.

12 Claims, 10 Drawing Sheets

(51) Int. Cl.

| | |
|---|---|
| ***A45D 40/20*** | (2006.01) |
| ***A46B 11/00*** | (2006.01) |
| ***B43K 23/008*** | (2006.01) |
| *A45D 34/00* | (2006.01) |
| *A45F 5/00* | (2006.01) |

(52) U.S. Cl.

CPC ... *A45D 2200/055* (2013.01); *A45D 2200/1018* (2013.01); *A45F 5/00* (2013.01); *A45F 2005/008* (2013.01); *A46B 2200/1046* (2013.01)

USPC ..... 401/8; 16/430

(56) References Cited

U.S. PATENT DOCUMENTS

| | | | | | |
|---|---|---|---|---|---|
| 4,127,338 | A | | 11/1978 | Laybourne | |
| 4,601,598 | A | * | 7/1986 | Schwartz et al. | 401/6 |
| 4,679,274 | A | | 7/1987 | Friedman | |
| D342,968 | S | * | 1/1994 | Meinke | D19/55 |
| 5,391,010 | A | * | 2/1995 | Gorbunov | 401/8 |
| 5,405,206 | A | | 4/1995 | Bedol | |
| 5,885,018 | A | | 3/1999 | Sato | |
| 5,893,671 | A | * | 4/1999 | Bellue | 401/6 |
| 6,161,974 | A | | 12/2000 | Nakagawa | |
| 6,328,493 | B1 | | 12/2001 | Starcherich | |
| 6,626,598 | B2 | | 9/2003 | Schneider | |
| 6,637,962 | B1 | | 10/2003 | Roche et al. | |
| 6,905,271 | B1 | | 6/2005 | Short | |
| 2003/0031496 | A1 | | 2/2003 | Schneider | |
| 2004/0001736 | A1 | | 1/2004 | Weaver et al. | |

FOREIGN PATENT DOCUMENTS

| | | |
|---|---|---|
| FR | 2 295 848 A1 | 7/1976 |
| FR | 2913318 | 9/2008 |
| GB | 2343149 | 5/2000 |
| WO | WO9313949 | 7/1993 |
| WO | WO 9734771 | 9/1997 |
| WO | WO9932010 | 7/1999 |
| WO | WO 03005853 | 1/2003 |

* cited by examiner

APPLICATOR DEVICE FOR A COSMETIC PRODUCT, AND ASSEMBLY COMPRISING SAME

CROSS-REFERENCE TO RELATED APPLICATIONS

This application claims the benefit of priority under 35 U.S.C. §119(e) of U.S. Provisional Application No. 61/320,546, filed Apr. 2, 2010, and claims priority under 35 U.S.C. §119 from French Application No. 10 50175, filed Jan. 12, 2010, the entire contents of each of which are herein incorporated by reference.

BACKGROUND OF THE INVENTION

1. Field of the Invention

According to a first aspect, the invention relates to an applicator device for a cosmetic product.

2. Discussion of Background

"Cosmetic product" refers in particular to a product as defined in Council directive 93/35/EC dated Jun. 14, 1993.

Known from GB 2 343 149 and U.S. Pat. No. 3,505,700 are applicator devices for cosmetic products intended to be worn by the end phalange of a user's finger, for example the index finger. It is difficult to draw a line with great precision with such devices, the applicator device veering off course at the slightest bending of the finger.

Also known from U.S. Pat. No. 4,679,274 and WO 99/32010 are toothbrushes provided to be worn by the last two phalanges of the finger. Such an assembly is acceptable for a toothbrush, but not for applying cosmetic products, which requires particularly precise control of the applicator's movements.

Also known from U.S. Pat. No. 336,540, U.S. Pat. No. 340,382, U.S. Pat. No. 6,637,962 and U.S. Pat. No. 6,893,177 are writing implements whereof the end opposite the tip is configured in a fork. One finger, for example the index finger, is slid between the two arms of the fork. These implements in particular make it possible to improve the writing comfort, without hindering the movements of the implement. In particular, the fork allows the writing implement to pivot from front to back relative to the fingers engaged in the fork. Such a degree of freedom is particularly important for cursive writing, which involves drawing a large number of loops with continual changes of orientation of the writing implement.

The use of forked sleeves is not advantageous for a cosmetic applicator. Indeed, the user moves the applicator essentially by moving the arm and the wrist, the applicator having to remain immobile relative to the fingers when one wishes to apply the cosmetic product with great precision. The forked sleeves are on the contrary provided to allow the movement of the of the implement relative to the fingers. Moreover, the forked sleeve, in the writing implements, is provided to allow support of the hand in a position where the wrist rests on the writing surface. In the case of application of a cosmetic product, the support for the hand is irrelevant, since the wrist does not rest on a support surface.

U.S. Pat. No. 657,370 and WO 93/13949 both describe a writing implement with a sleeve including a closed loop provided to receive the index finger of the user's hand. The shape, incline, and size of the loops are provided so as not to hinder the tilting motion of the writing implement relative to the index finger, for the aforementioned reasons. Such rings are therefore useless for cosmetic applicators, because they do not contribute to immobilizing the applicator relative to the finger.

U.S. Pat. No. 6,161,974 describes a writing implement with a sleeve having a closed orifice. In one alternative embodiment, the size and position of the closed orifice are provided so that the user's middle finger is engaged in the orifice, the hand in the writing position including at least three fingers folded against the palm, i.e. the middle finger, the ring finger, and the pinky finger. Such a position is not convenient for applying a cosmetic product with great precision.

Lastly, known from U.S. Pat. No. 427,338, WO 97/34771, U.S. Pat. No. 5,405,206, U.S. Pat. No. 5,885,018 and U.S. Pat. No. 6,905,271 are writing instruments mounted by rings on the second phalange of the user's index finger. Such devices do not allow very precise guiding of the writing implement. It is therefore not possible to consider using them to apply cosmetic products.

Thus, no devices are known that are adapted to applying cosmetic products and that can be conveniently locked in position relative to the fingers of the hand, so as to allow an extremely precise application of the cosmetic product.

SUMMARY OF THE INVENTION

To that end, the invention relates to a cosmetic applicator device, comprising:

- a body;
- a cosmetic applicator member connected to a first longitudinal end of the body;
- a holding ring adapted to be engaged around an anterior phalange of one of the user's fingers, with a size adapted to allow simultaneous bearing of two opposite zones of the ring on the finger when the anterior phalange is engaged through the ring;
- the ring being connected to a second longitudinal end of the body opposite the first, such that the body offers at least one bearing zone for an end phalange of said finger of the user when the anterior phalange is engaged through the ring.

Thus, the applicator is solidly connected to the finger engaged in the ring, and cannot pivot relative to the finger around the bearing zone of the body. Compared to an applicator device held like a pencil, the applicator of the invention has considerably fewer degrees of freedom relative to the user's hand. It is therefore easier to guide during application of the cosmetic product, in particular to make continuous lines.

The device can also have one or several of the following features, considered individually or according to all technically possible combinations.

The ring can have a size adapted to allow the simultaneous bearing of two opposite zones of the ring on the finger, one near the joint of the anterior phalange to a palm of the hand, the other near the joint of the anterior phalange to the intermediate phalange of the finger.

The use of such a ring is particularly advantageous because it makes it possible to force the user not to use the applicator like a pencil. Indeed, in the absence of such a ring, the user would tend to pivot the applicator frequently during application of the cosmetic product. The use of a ring limits this possibility and therefore forces the user to apply the cosmetic product by moving the device using a movement of the hand and arm only and not by moving the fingers. The movement of the fingers is prevented by the structure of the applicator.

The two bearing zones of the ring can be opposite each other along the longitudinal direction. Thus, the applicator device is particularly well held by the user, who can easily lock it and prevent any undesirable parasitic movements that could cause the applicator member to deviate from its desired course during application of the cosmetic product.

Moreover, the fact that the body offers an additional bearing zone for the anterior phalange of the finger engaged in the ring, in addition to the two bearing zones of the ring, makes it possible to completely block the movement of the fingers. Indeed, the thumb can be positioned on the body, opposite the additional bearing zone, and exert an excess stress on the finger engaged in the ring by gripping the body between the thumb and the finger.

The device can comprise a hollow zone for receiving a store of cosmetic product, provided to supply the applicator member with cosmetic product.

Thus, the applicator device is particularly compact and convenient to use.

The ring can comprise an annular core and a sheath made from a flexible material slipped on the core. Thus, the contact between the user's finger and the ring is more pleasant.

The ring can have a closed contour. In this case, gripping is better.

The ring can include a lateral break. The lateral break makes it possible to hang and above all take down the applicator device in display cases including horizontal rods on which the applicators are placed behind each other using their rings. The break also makes it possible to more easily engage the finger in the ring.

The device can include a means for varying a longitudinal length of the ring. Thus, it is possible to adapt the side of the ring of the applicator to that of the user's finger and hand.

The body can have, perpendicular to the longitudinal direction, a triangular section. The triangular section is particularly convenient because it makes it possible to easily grasp the body between three fingers.

The body can offer two bearing zones for two of the user's fingers, the two bearing zones being situated on two planar faces of the body, said faces being parallel to each other. Thus, it is possible to guide the applicator and keep it in position using only two fingers, the finger engaged in the ring remaining free.

The body can have a bead protruding relative to the bearing zone, the bead adjoining the bearing zone towards the applicator member. The bead makes it possible to lock the end of the user's finger along the body. It makes it possible to prevent the finger from sliding longitudinally, in particular after extended use.

The ring can be in a plane containing the longitudinal direction, or in a plane forming an angle smaller than 30° with the longitudinal direction. Such an incline is particularly adapted for good maintenance of the applicator in the user's hand.

The bearing zone can be situated on a planar face of the body substantially parallel to the ring. Such an orientation of the bearing zone is particularly convenient for positioning the end phalange of the finger engaged in the ring.

The applicator member for the cosmetic product can be removably secured to the first longitudinal end of the body. It is thus possible to use different applicator members with a same applicator.

According to a second aspect, the invention pertains to an assembly comprising a container containing a cosmetic product, an applicator of the cosmetic product having the aforementioned features, and a removable connection of the container to the applicator provided so that the applicator member is engaged in the container. Such an assembly makes it possible to associate the applicator device with a store containing a large quantity of cosmetic product. The store is easily refillable. As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particular since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

Other features and advantages of the invention will emerge from the detailed description provided below, for information and in no way limitingly, in reference to the appended figures, among which.

DETAILED DESCRIPTION OF THE PREFERRED EMBODIMENTS

Figure 1:
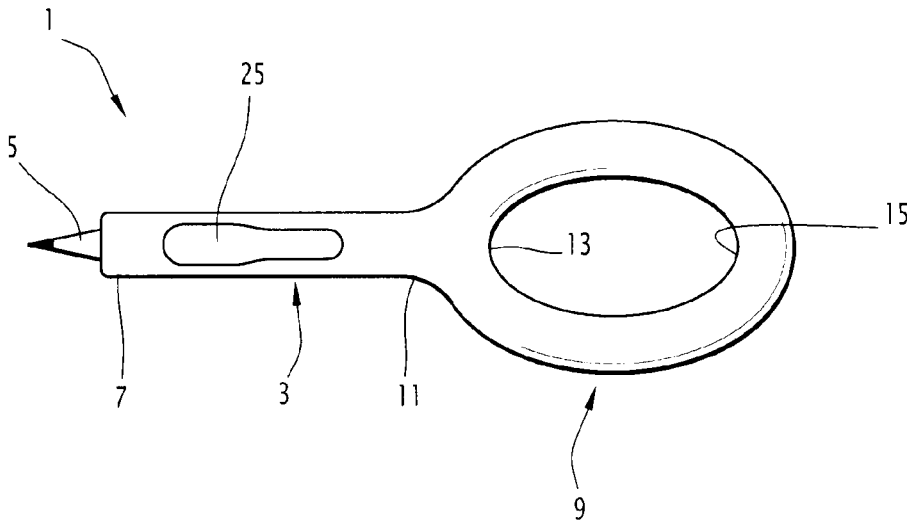
FIG. 1 is a top view of a cosmetic applicator according to the invention.

Referring now to the drawings, like reference numerals are utilized to designate identical or corresponding parts throughout the several views.

Figure 2:
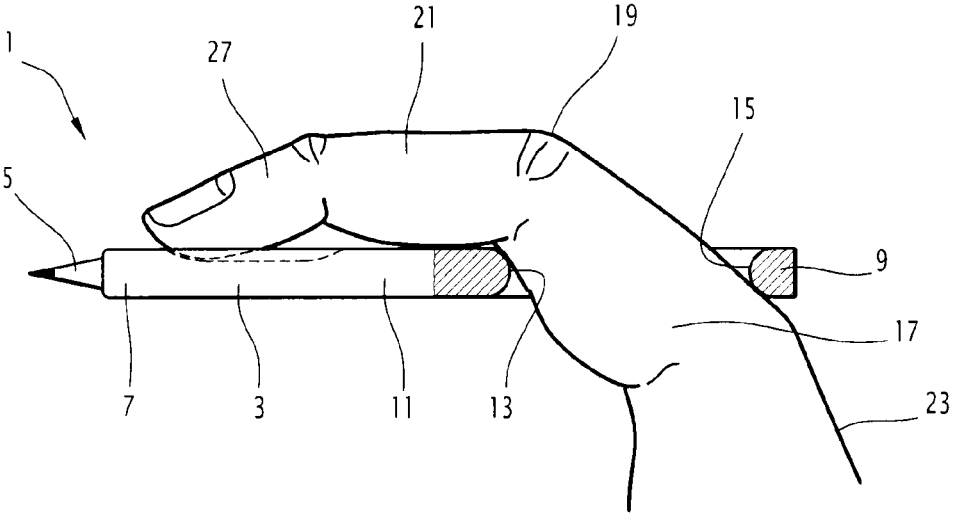
FIG. 2 is a side view of the applicator of FIG. 1, one of the user's fingers being shown engaged in the ring of the device.

The device shown in FIGS. 1 and 2 is provided for the application of a cosmetic product. This cosmetic product can be of any type: liquid, pasty, solid, or take the form of a cream, etc. . . . . The cosmetic product can be intended for makeup (lipstick, eyeliner, mascara, eye shadow, eye contour pencils, lip liner pencils . . . ) or to be intended for skin care (serum, contour of the eyes, anti-ring . . . ).

Figure 3:
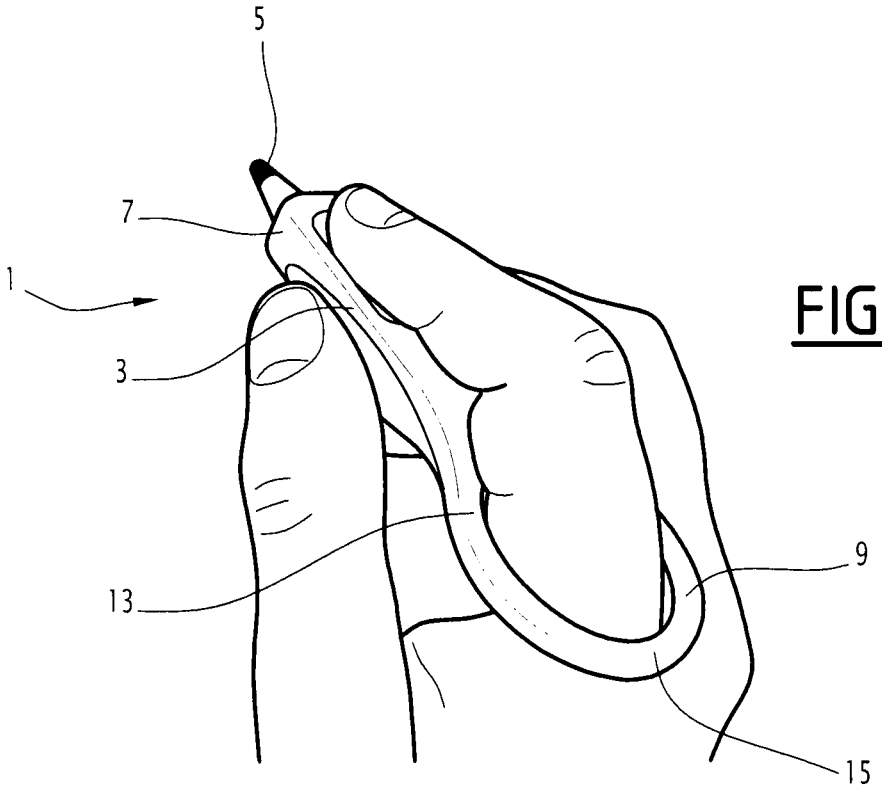
FIG. 3 is a perspective view illustrating the position of a user's hand grasping the device of FIG. 1.

In the embodiment of FIGS. 1 to 3, the device includes:

a body 3;

a cosmetic applicator member 5 connected to a first longitudinal end 7 of the body 3;

a holding ring 9, connected to a second longitudinal end 11 of the body, opposite the first.

As shown in FIG. 2, the holding ring 9 is adapted to be engaged around the anterior phalange of a user's finger. In the following description, "anterior phalange" refers to the finger directly articulated on the palm of the hand. "End phalange" refers to the last phalange of the finger, bearing the nail. "Intermediate phalange" refers to the phalange connecting the anterior phalange to the end phalange.

The ring 9 has a size adapted to allow simultaneous bearing of two zones 13, 15 of the ring on the finger, when the anterior phalange 17 is engaged through the ring 9. The zone 13 is provided to bear near the joint 19 of the anterior phalange to the intermediate phalange. The zone 13 can bear against part of the anterior phalange 17 that adjoins the joint 19, or against part of the intermediate phalange 21 that adjoins the joint 19, or directly against the joint 19.

The zone 15 is provided to bear against the finger near the joint 23 of the anterior phalange 17 to the palm of the hand. The zone 15 can bear against part of the anterior phalange 17, or directly on the joint 23, and can even overhang the palm of the hand.

The zone 15 bears on the top of the finger, whereas the zone 13 bears on the bottom of the finger. "Top of the finger" here refers to the side of the finger facing the same direction as the back of the hand. "Bottom of the finger" refers to the side of the finger facing the same side as the inner palm of the hand.

Thus, zones 13 and 15 bear on two circumferentially opposite parts of the finger.

As shown in FIGS. 1 and 2, the zones 13 and 15 of the ring are opposite each other along the longitudinal direction.

The ring 9 has a generally elliptical, or oval, shape. The large axis is substantially along the longitudinal direction. The small axis is substantially transversal. The zones 13 and 15 are the zones of the ring situated at the two opposite ends of the large longitudinal axis.

The body 3 assumes the form of a sleeve elongated in the longitudinal direction. It can form a single piece with the ring 9. For example, the sleeve and the ring are made from a plastic material such as polypropylene or polyethylene, and are obtained by injection.

Figure 4:
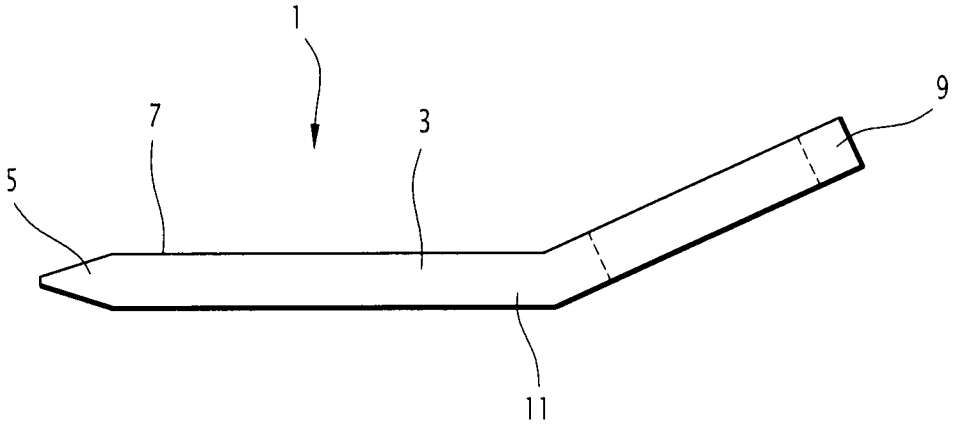
FIG. 4 is a side view of an alternative of the applicator in which the ring is in a plane that is inclined relative to the body.

As shown in FIG. 2, the body 3 and the ring 9 can be situated in a same plane containing the longitudinal direction. Alternatively, as shown in FIG. 4, the ring 9 can extend in a plane forming an angle smaller than 30° relative to the longitudinal direction. Preferably, the ring 9 forms an angle smaller than 20° relative to the longitudinal direction, and more preferably smaller than 10°.

Figure 5:
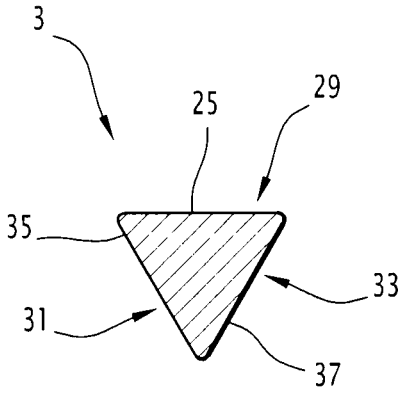
FIGS. 5 to 7 are cross-sectional views of the body of the applicator, in a transverse plane perpendicular to the longitudinal direction.

As shown in FIG. 2, the body 3 offers at least one bearing zone 25 for the end phalange 27 of the user's finger when the anterior phalange 17 is engaged through the ring 9. As shown in FIG. 5, the body 3 can have, considered in cross-section perpendicular to the longitudinal direction, a triangular transverse section. The body can be configured to have this triangular section only at the bearing zone 25, or alternatively over its entire longitudinal length.

Thus, at the bearing zone 25, the body 3 is defined by three substantially planar faces, referenced 29, 31 and 33, respectively. The bearing zone 25 is situated on the face 29. Preferably, the face 29 is substantially parallel to the ring 9. The angles between the faces 31 and 33 of the face 29 can vary, for example between 20° and 80°. As shown in FIG. 3, the planar faces 31 and 33 offer bearing zones referenced 35 and 37, respectively, for the thumb and another one of the user's fingers, when one of the fingers is engaged through the ring. In the illustration of FIG. 3, the index finger is engaged in the ring, and the faces 31, 33 offer bearing zones for the thumb and the middle finger.

Figure 6:
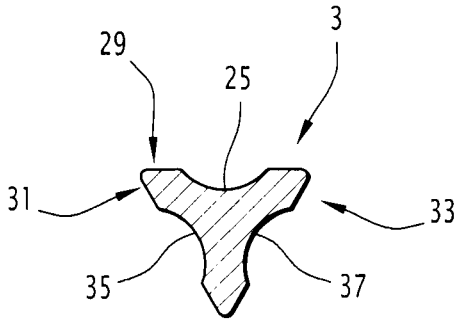

The bearing zones 25, 33 and 37 can be concave, as shown in FIG. 6. Alternatively, only one or two of the bearing zones can be concave.

Figure 7:
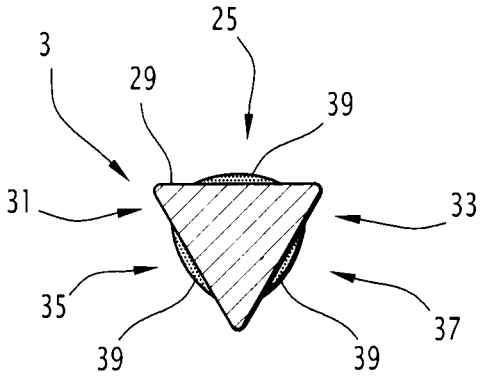

Alternatively, one or several of the zones 25, 35 and 37 can include an elastic bock 39, for example made from an elastomer, as illustrated in FIG. 7. This elastic block improves the user's comfort. Moreover, it prevents the user's finger from sliding on the body. The elastic block 39 could be replaced by a series of streaks or reliefs, in one alternative embodiment (not shown). The block(s) can be obtained by over-molding, mechanical assembly, adhesion, welding, etc.

Figure 8:
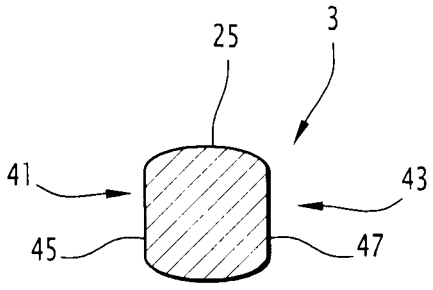
FIG. 8 is a cross-sectional view similar to that of FIGS. 5 to 7, for an alternative embodiment in which the body has two parallel bearing zones opposite each other.

In one alternative embodiment illustrated in FIG. 8, the body 3 has two planar faces 41 and 43, opposite and substantially parallel to each other, offering two bearing zones 45 and 47, respectively, for two of the user's fingers. The planar faces 41 and 43 are typically substantially perpendicular to the plane in which the ring 9 fits. The bearing zones 45 and 47 are provided to receive the end phalanges of two fingers that are not slipped into the ring 9, for example the thumb and the middle finger. The bearing zone 25 for the end phalange of the finger engaged in the ring is then formed on a surface of the body connecting the two planar faces 41 and 43 to each other. In this alternative embodiment, the body is designed to be held and guided primarily by the two fingers resting on the bearing zones 45 and 47. The bearing zone 25 allows additional guiding and also makes it possible to rest the finger engaged in the ring 9.

The surface connecting the two faces 41 and 43 to each other can have all sorts of profiles: planar, curved, concave, etc. . . . .

Figure 9:
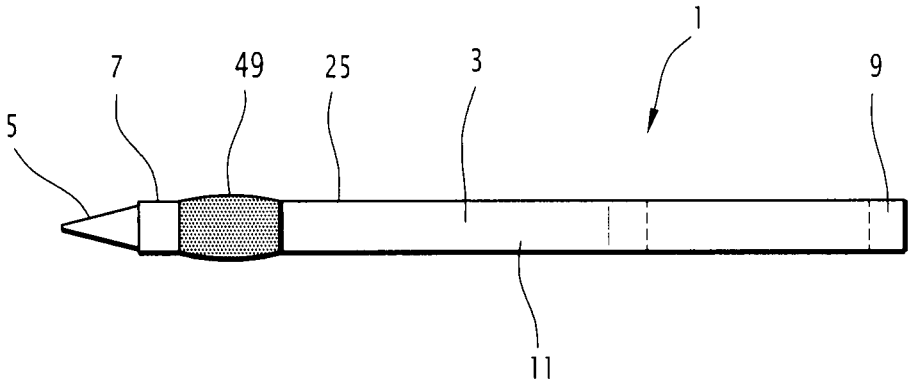
FIG. 9 is a side view of an alternative of the applicator in which the body has a bearing bead adjoining the bearing zone of the user's fingers.

In the alternative embodiment shown in FIG. 9, the body 3 has a bead 49 protruding relative to the bearing zone 25, the bead 49 adjoining the bearing zone 25 towards the applicator member 5 and towards the first end 7 of the body. The bead 49 can extend circumferentially around the body 3. The bead 49 can extend circumferentially only along the zone 25, for example on the face 29 of the body. It allows the user to longitudinally lock the end of her finger.

The bead 49, considered in longitudinal section, can have all sorts of shapes: rounded, rectangular, etc. . . . . It can be made from the same material as the body 3, or be made from an elastomer material. In the latter case, it can be obtained by over-molding, mechanical assembly, adhesion, welding, etc.

Figure 10:
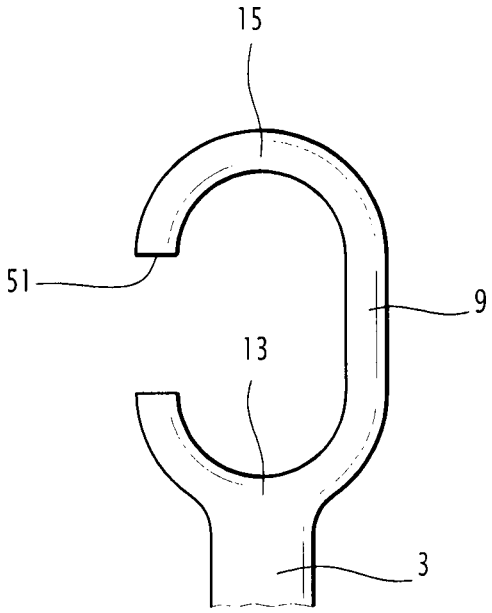
FIG. 10 is a top view of an alternative embodiment in which the ring is laterally open.

In one alternative shown in FIG. 10, the ring can include a lateral break 51. Thus, the ring is open. The break 51 is for example situated at the small axis of the ring.

In an embodiment shown in FIGS. 11 to 14, the applicator includes a hollow zone 53 for receiving a store of cosmetic product, provided to supply the applicator with cosmetics.

Figure 11:
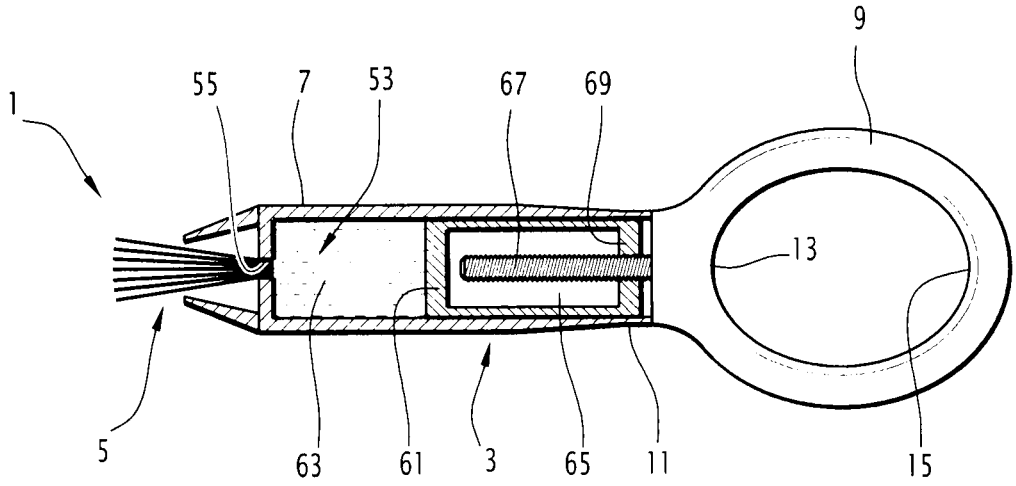
FIGS. 11 and 12 are longitudinal partial cross-sectional views, of alternative embodiments in which the body of the applicator contains a store of cosmetic product, the cosmetic product being a fluid in FIG. 11 and a lead in FIG. 12.
Figure 12:
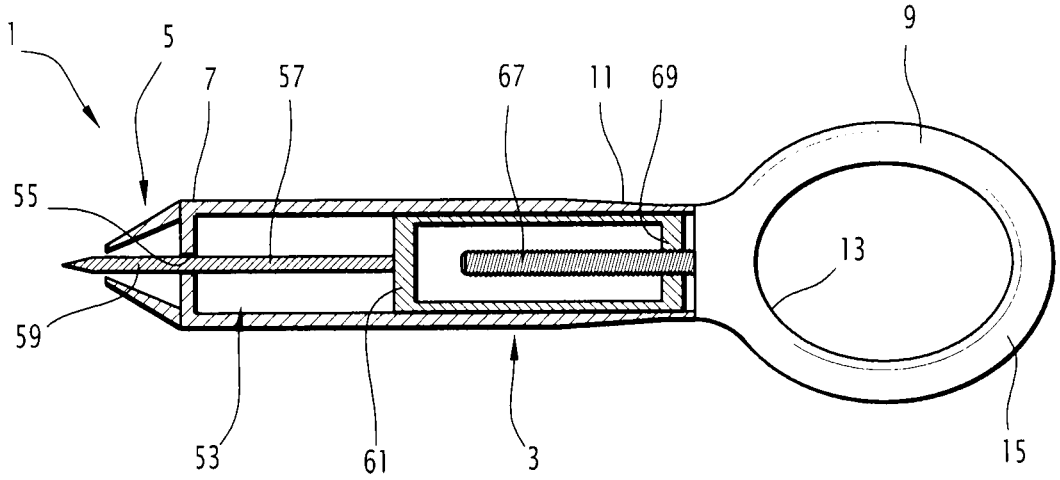
Figure 13:
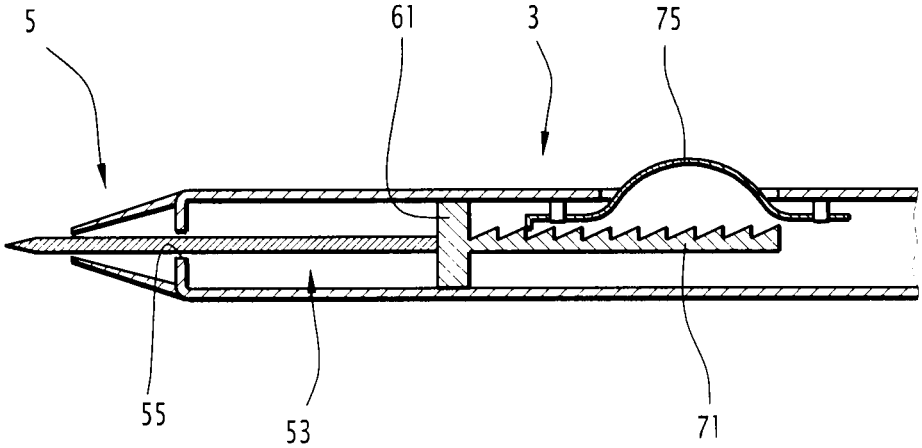
FIG. 13 is a view similar to that of FIGS. 11 and 12, in which the screw making it possible to expel the cosmetic product is replaced by a rack.

Preferably, this hollow zone is formed in the body 3 of the applicator. In FIGS. 11 to 13, the cosmetic product is directly received in the hollow zone 53. This has an orifice 55 emerging in the first end 7 of the body, to allow the cosmetic product to escape and supply the applicator member. The cosmetic product can be a fluid product, as shown in FIG. 11. The size of the orifice 55 is in this case dimensioned as a function of the viscosity of the cosmetic product, such that it cannot flow outside the hollow zone 53 in the absence of stress by the user. In the case of FIG. 11, the applicator is for example of the brush type.

The cosmetic product can also assume the form of a poured lead, of the Kohl pencil type, or the lip liner pencil type. In this case, the cosmetic product assumes the form of a longitudinal bar 57 with a section substantially corresponding to the section of the orifice 55. Part of the bar protrudes outside the hollow volume 53, as shown in FIG. 12.

In the case of FIGS. 11 to 13, the applicator includes a mechanical assembly making it possible to progressively drive the cosmetic product out of the hollow volume 53. This assembly is for example of the piston type. Thus, it includes a piston 61 that is longitudinally mobile inside the hollow zone 53, and moving towards the end 7. In FIG. 11, the piston 61 sealably divides the hollow zone 53 into a volume 63 filled with liquid cosmetic product, and an empty volume 65 from which the cosmetic product has already been driven. The zone 63 is situated on the side of the piston facing the orifice 55. The piston 61 is for example moved via a screw/nut system. This system includes a threaded rod 67 integral with the ring 9. The ring in this case is mounted rotating relative to the body 3, around a longitudinal axis constituting the central axis of the body 3. The system also includes a nut 69, movable along the threaded rod 67. The nut 69 is rigidly connected to the piston 61 using a system of cross-pieces. It is locked in rotation around the threaded rod 67. Thus, when the user makes the ring 9 pivot relative to the body 3, it moves the nut 69 towards the first end of the body 3, also driving the piston 61.

In FIG. 12, the bar 57 is rigidly fastened to the piston 61. The system making it possible to move the piston 61 inside the body 3 is identical to that described above in reference to FIG. 11.

In FIG. 13, the system making it possible to move the piston 61 is of the rack type.

Thus, this system includes a longitudinal rack 71 integral with the piston 61, and an actuator 75. The actuator 75 is for example a bowed elastic blade, protruding relative to the outer surface of the body 3. When the user presses on the bowed blade 75, it extends longitudinally and drives the rack 71 and the piston 61 longitudinally.

Figure 14:
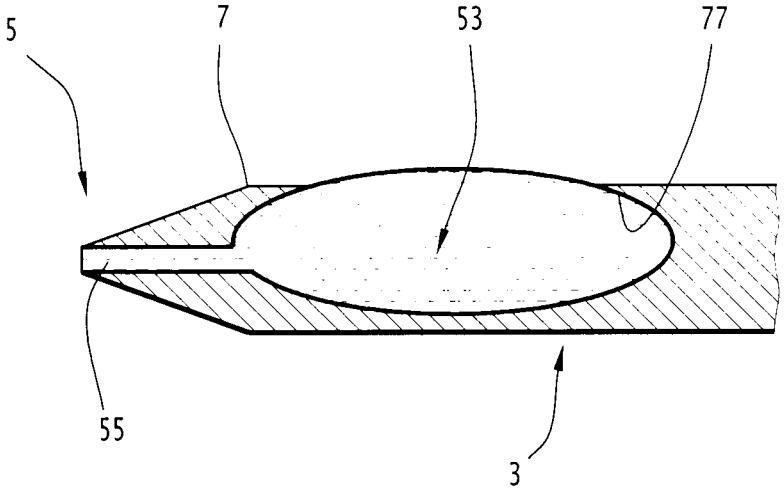
FIG. 14 is a cross-sectional view similar to that of FIG. 13, for another alternative embodiment of the invention in which the body contains a hollow zone provided to receive a disposable bag constituting the store of cosmetic product.

In the embodiment of FIG. 14, a flexible reservoir 77 is arranged in the hollow zone 53 of the applicator. The flexible reservoir 77 contains a store of cosmetic product. The flexible reservoir can be of the flexible small vial or bag type. It can contain a quantity of cosmetic product that is just sufficient for a single application, or on the contrary a larger quantity of cosmetic product, allowing several applications.

In this case, it is necessary to open the flexible reservoir 77 upon the first use, and to place the opening connected with the orifice 55 of the body. The cosmetic product is then distributed via pressure with the index on the flexible reservoir, for example through a window formed in the body 3 and emerging in the hollow zone 53.

Figure 15:
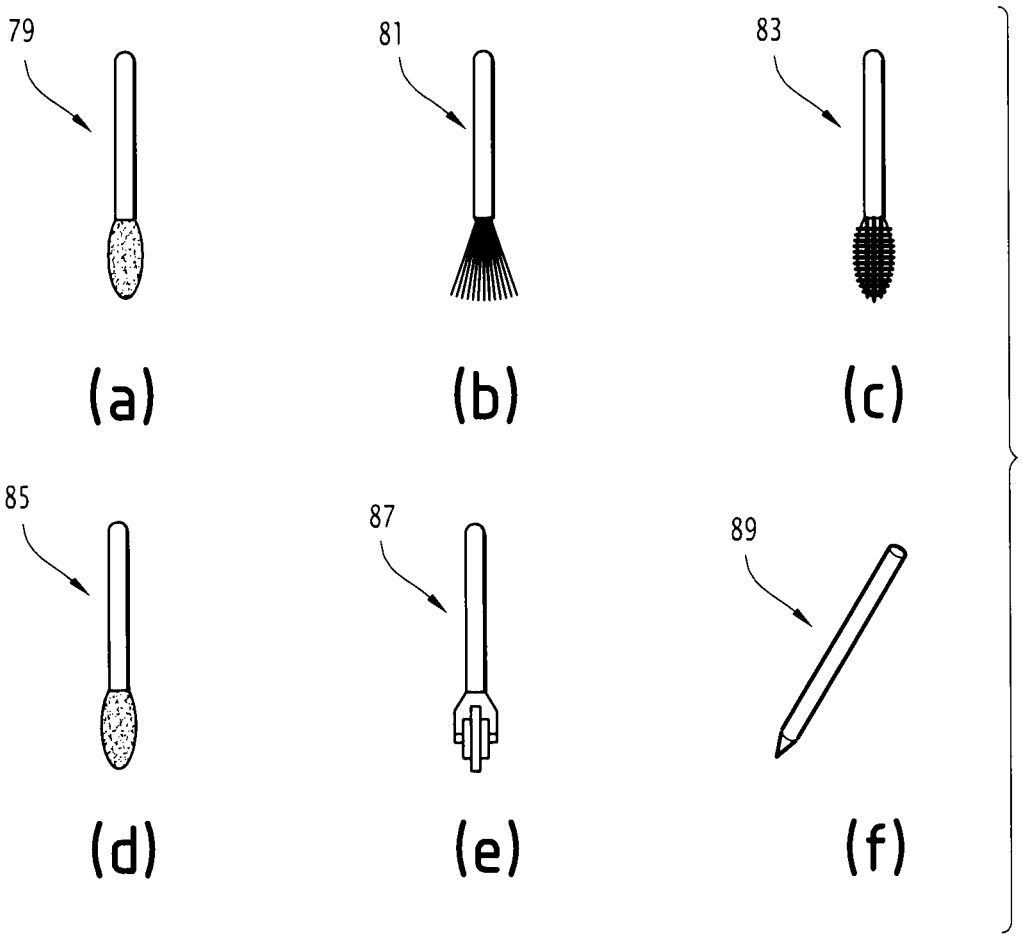
FIGS. 15*a* to 15*f* show different types of applicator members capable of being incorporated in the device of the invention.

The applicator member 5 can be of any type. It can include a foam, felt, sintering, woven or non-woven material, or sponge 79, as illustrated in FIG. 15*a*. The applicator member can be a paintbrush 81 (FIG. 15*b*), a brush or comb 83 (FIG. 15*c*), a porous thermoplastic 85 (FIG. 15*d*), a flocked nozzle, a synthetic foam covering a molded portion or a spatula. The applicator member can also be a castor (FIG. 15*e*) or a pencil (FIG. 150. The applicator member can also be a nozzle, as shown in FIG. 14.

The applicator member can also be rigidly fastened to the body 3, or on the contrary can be fastened removably to the first end 7 of the body 3 and be interchangeable. It is in fact particularly advantageous to be able to use the same applicator with different applicator members, making it possible to perform different things. In this case, the applicator member can be mounted on the body 3 using all suitable means, for example by screwing, locking, etc. The applicator member can also be formed by the first end 7 of the body 3, as in FIG. 14. The device is then a kit with a body provided with a holding ring, and several interchangeable applicator members, each dedicated to a determined application or treatment.

So as to adapt to the size of the user's hand, the applicator can include a means for varying the longitudinal length of the ring, as shown in FIGS. 16 to 20.

Figure 16:
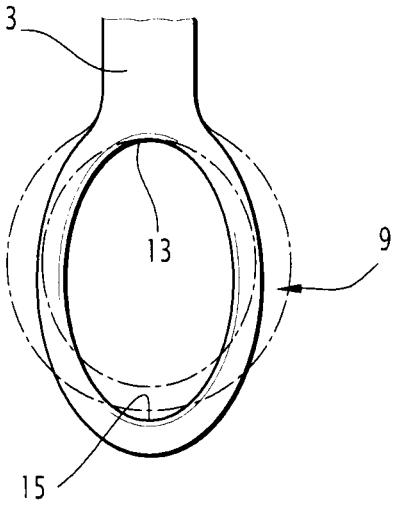
FIGS. 16 to 19 show different types of rings with adjustable longitudinal lengths.

According to a first alternative shown in FIG. 16, the ring 9 is completely made from a flexible material that is deformable. It can also be made from an elastic material, such as TPE (Thermo Plastic Elastic).

It is then possible to longitudinally elongate or shorten the ring, by deforming it so as to ovalize it or give it a more circular shape.

Figure 17:
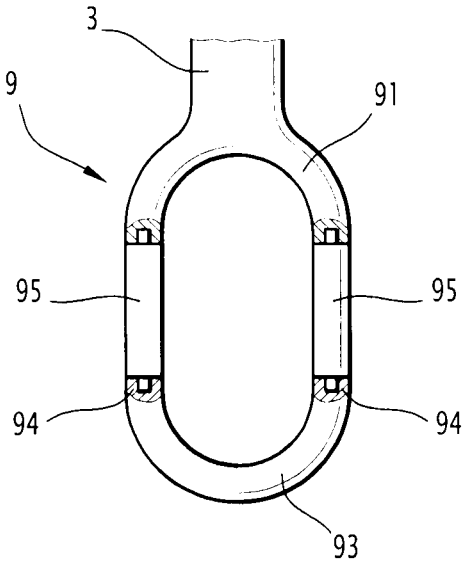

In the alternative of FIG. 17, the ring 9 includes two half-rings 91 and 93, separable from each other. For example, the ring 9 has two arms 94 oriented substantially longitudinally capable of being cut, for example at the small axis of the ring. Two separator extensions 95 can be inserted longitudinally in these arms 94, between the two half-rings 91 and 93, in order to extend the ring 9 longitudinally. Each extension 95 includes means for being removably fastened to the two half-rings 91 and 93, for example a mortise-and-tenon connection.

Figure 18:
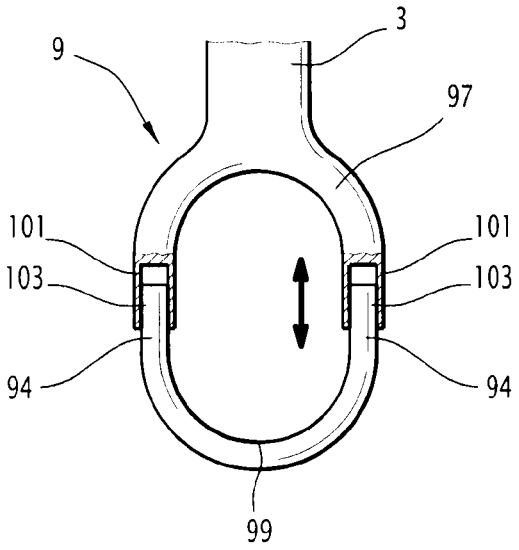

In the alternative of FIG. 18, the ring 9 is formed by two half-rings 97 and 99 sliding longitudinally, telescopically, relative to each other. The two half-rings interlock one in the other substantially at the center of the longitudinal arms 94 of the ring 9. One of the half-rings, for example the half-ring 97, has hollowed out free ends 101. Moreover, the free ends 103 of the half-ring 99 are engaged in the hollowed out ends 101, slidingly. The ends 101 and 103 are oriented substantially longitudinally, which allows longitudinal sliding of the two half-rings relative to each other, and an adjustment of the longitudinal length of the ring 9.

Figure 19:
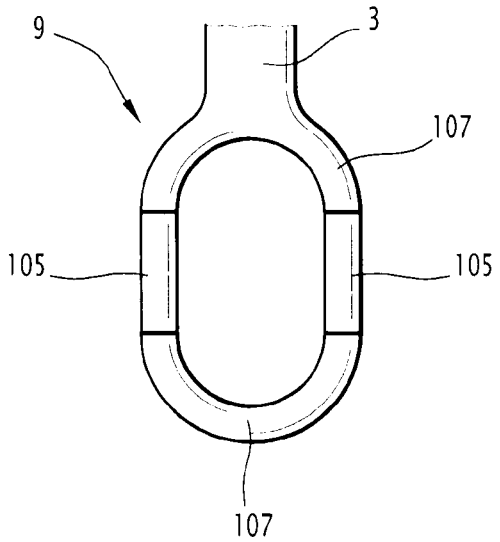
Figure 20:
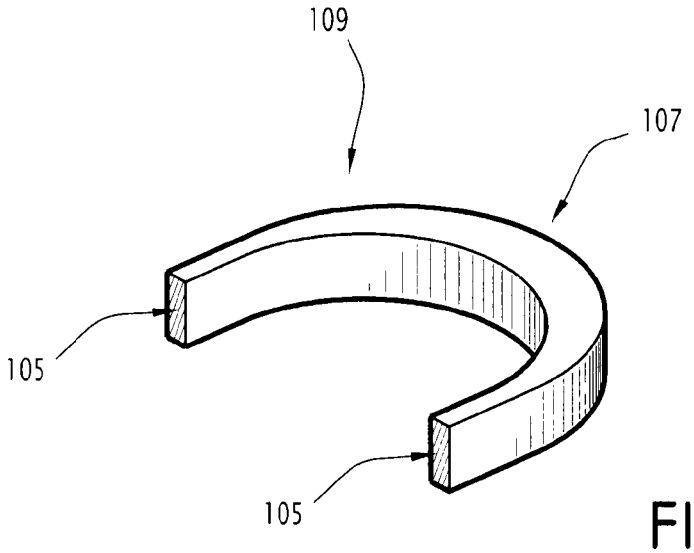
FIG. 20 is a perspective view of part of the ring of FIG. 19, another part having been removed to show the section of the longitudinal arms.

In the embodiment of FIG. 19, the ring 9 includes two longitudinal arms 105 opposite each other made from a flexible material, connected to each other by two bowed portions 107 made from a rigid material. One of the bowed portions 107 is rigidly fastened to the body 3. In this case, the ring 9 can be formed by elements made from different materials, secured to each other. The arms 105 can for example be made up of natural or synthetic rubber, and the portions 107 made up of a hard plastic material. Alternatively, as illustrated in FIG. 20, the arms 105 and the portions 107 can be zones of a same blade with a variable section. For example, in the portions 107 the blade 109 has a larger section, giving the blade greater stiffness. In the arms 105, the blade 109 has a smaller section, or a section with a shape adapted to give the arms 105 greater flexibility.

Figure 21:
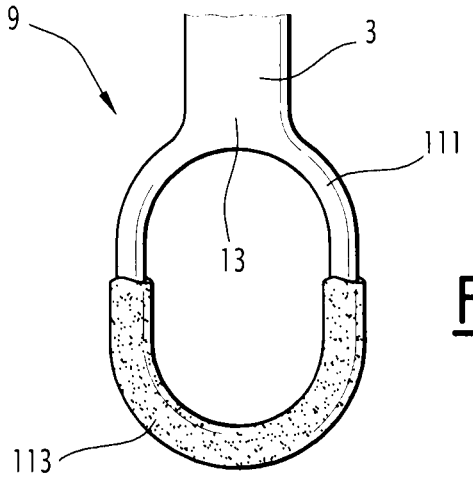
FIG. 21 is a top view of an alternative embodiment of the ring including a sheath made from a flexible material, only part of the sheath being shown.

To increase the user's comfort, the ring 9 can include a rigid annular core 111 and a sheath 113 made from a flexible material slipped on the core 111, as illustrated in FIG. 21. The sheath 113 is for example made from an elastomer. The core 111 is for example made from a rigid plastic material.

Figure 22:
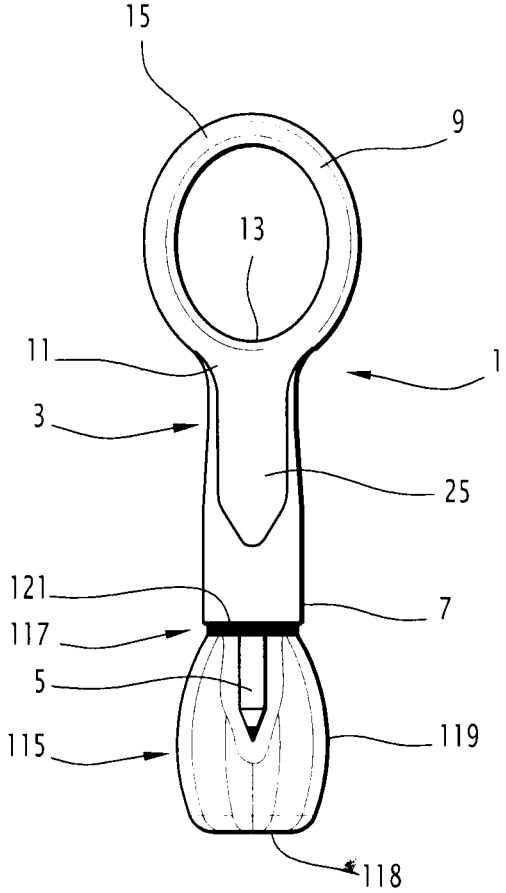
FIG. 22 is a top view of an alternative embodiment of the invention in which the applicator device is associated with a container containing a store of cosmetic product.

According to a second aspect, the invention relates to an assembly including, as shown in FIG. 22, a container 115 containing cosmetic product, an applicator 1 as described above, and a removable connection 117 connecting the container 115 to the applicator 1. The container 115 typically includes a bottom 118, and a peripheral wall 119 defining an opening 121 provided to engage the applicator member 5 in the container. The connection 117 is provided so that the first end of the body 3 can be fastened to the container 115, in a storage position shown in FIG. 22 in which the applicator member 5 is engaged in the container 115. The applicator 5 passes through the orifice 121. The first end 7 of the body forms a cap covering the orifice 121.

The connection 117 can be of any type. The first end 7 of the body can be forcibly engaged around the container 3. It can be screwed to the container 115, fastened by locking, etc. The connection between the body 3 and the container 115 is preferably sealed.

Obviously, numerous modifications and variations of the present invention are possible in light of the above teachings. It is therefore to be understood that within the scope of the appended claims, the invention may be practiced otherwise than as specifically described therein.

The invention claimed is:

1. An applicator for a cosmetic product, comprising:

a body;

a cosmetic applicator member connected to a first longitudinal end of the body; and a holding ring adapted to be engaged around an anterior phalange of one of a user's fingers, the holding ring being connected to a second longitudinal end of the body opposite the first longitudinal end, such that the body offers at least one bearing zone for an end phalange of said finger of the user when the anterior phalange is engaged through the holding ring, said first longitudinal end and second longitudinal end of the body defining a longitudinal direction, wherein the ring is in one of a plane containing the longitudinal direction, or in a plane forming an angle smaller than 20° with the longitudinal direction, and wherein the holding ring has a size configured to allow the simultaneous bearing of two opposite zones of the holding ring on the finger, one of the two opposed zones being near a joint of the anterior phalange to a palm of the hand, the other zone being near the joint of the anterior phalange to an intermediate phalange of the finger.

2. The applicator according to claim 1, wherein the two opposite zones of the holding ring can be opposite to each other along the longitudinal direction.

3. The applicator according to claim 1, further comprising a hollow zone that receives and stores cosmetic product.

4. The applicator according to claim 1, wherein the holding ring includes an annular core and a sheath made from a flexible material slipped on the core.

5. The applicator according to claim 1, wherein the holding ring has a closed contour.

6. The applicator according to claim 1, wherein the holding ring includes a lateral break.

7. The applicator according to claim 1, further comprising a means for varying a longitudinal length of the holding ring.

8. The applicator according to claim 1, wherein the body is configured to include a triangular section perpendicular to the longitudinal direction.

9. The applicator according to claim 1, wherein the body offers two additional bearing zones for two of the user's fingers, the two additional bearing zones being situated on two planar faces of the body, said faces being parallel to each other.

10. The applicator according to claim 1, wherein the body includes a bead protruding relative to the bearing zone, the bead adjoining the bearing zone towards the applicator member.

11. The applicator according to claim 1, wherein the bearing zone can be situated on a planar face of the body substantially parallel to the ring.

12. The applicator according to claim 1, wherein the cosmetic applicator member for the cosmetic product can be removably secured to the first longitudinal end of the body.

* * * * *